US009821553B2

(12) United States Patent
Yamamoto et al.

(10) Patent No.: US 9,821,553 B2
(45) Date of Patent: Nov. 21, 2017

(54) LIQUID DISCHARGING HEAD

(71) Applicant: CANON KABUSHIKI KAISHA, Tokyo (JP)

(72) Inventors: Akira Yamamoto, Yokohama (JP); Yasuhiko Osaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/074,939

(22) Filed: Mar. 18, 2016

(65) Prior Publication Data

US 2016/0279936 A1 Sep. 29, 2016

(30) Foreign Application Priority Data

Mar. 24, 2015 (JP) ..... 2015-060852

(51) Int. Cl.
*B41J 2/135* (2006.01)
*B41J 2/045* (2006.01)
*B41J 2/14* (2006.01)

(52) U.S. Cl.
CPC ..... *B41J 2/14145* (2013.01); *B41J 2202/12* (2013.01); *B41J 2202/19* (2013.01); *B41J 2202/20* (2013.01); *B41J 2202/21* (2013.01)

(58) Field of Classification Search
CPC ..... B41J 2002/14419; B41J 2202/20; B41J 2/14201; B41J 2/1433; B41J 2/14145; B41J 2002/14362; B41J 2202/21; B41J 2/14; B41J 2202/19; B41J 2202/12; B41J 2/145
USPC ..... 347/6, 40, 44, 47, 65, 71, 85
See application file for complete search history.

(56) References Cited

U.S. PATENT DOCUMENTS

2009/0141091 A1* 6/2009 Murakami ..... B41J 2/1404 347/65

FOREIGN PATENT DOCUMENTS

JP 2011-240521 A 12/2011

* cited by examiner

*Primary Examiner* — Jannelle M Lebron
(74) *Attorney, Agent, or Firm* — Canon U.S.A., Inc. IP Division

(57) ABSTRACT

A liquid discharging head includes a support member and plural print element substrates through which a liquid is discharged. The print element substrates are disposed on the support member and provided with the liquid through a liquid supply channel formed in the support member. The sectional area of the liquid supply channel at a position corresponding to each of the print element substrates is determined in accordance with an order in which the print element substrates are provided with the liquid.

7 Claims, 18 Drawing Sheets

LIQUID DISCHARGING HEAD

BACKGROUND OF THE INVENTION

Field of the Invention

The present invention relates to a liquid discharging head that discharges a liquid from plural discharge ports.

Description of the Related Art

It is advantageous to use a long liquid discharging head including an array of many discharge ports from which a liquid is discharged, in order to achieve high speed printing onto a recording medium. In particular, a full-line-type liquid discharge printing apparatus, which continuously feeds a recording medium and discharges ink for printing, uses a liquid discharging head including a long array of discharge ports having a length larger than the width of the recording medium. Such a liquid discharging head is typically configured by arranging relatively short print element substrates each including the discharge ports and heat-generating resistance elements that generate thermal energy in order to discharge the liquid from the discharge ports. This configuration enables the liquid discharging head including the long array of discharge ports to be readily provided at low cost. For the configuration of the arranged print element substrates, however, a difference in temperature that occurs in the interior of each print element substrate or among the print element substrates may cause a difference in the amount of discharged liquid. Accordingly, the difference in temperature that occurs in the interior of each print element substrate and the difference in temperature that occurs among the print element substrates need to be controlled so as to be restricted within a predetermined range.

As the liquid discharging head that performs such control, Japanese Patent Laid-Open No. 2011-240521 discloses a liquid discharging head in which each print element substrate is provided with a main channel through which a liquid is supplied and the liquid circulating through the main channel cools the print element substrates. In this liquid discharging head, heat generated by the heat-generating resistance elements when the liquid is discharged is divided into heat transferred to a support member that supports the print element substrates and heat transferred to the liquid. The heat transferred to the support member is transferred to the circulating liquid and the support member is thereby cooled. Thus, the heat generated in the print element substrates is successively transferred to the liquid via the support member, and an increase in the temperature of the print element substrates can be suppressed.

For current liquid discharge apparatuses, however, discharge frequency is further increased and the length of the liquid discharging head is further increased to achieve high speed printing and large size printing, and the number of discharges per unit time and a calorific value per unit time are likely to increase. Accordingly, the liquid discharging head disclosed in Japanese Patent Laid-Open No. 2011-240521 cannot sufficiently cool the print element substrates, and in some cases, it is difficult to restrict the difference in temperature in the interior of each print element substrate and the difference in temperature among the print element substrates to be within a predetermined range. In these cases, the amount of liquid discharged from the discharge ports in the interior of the liquid discharging head varies and this variation causes degradation in the quality of images. It is difficult to solve the problem of the variation in the amount of the discharged liquid by merely increasing the flow rate of the circulating liquid. It is known that even though the increase in the flow rate of the liquid may decrease the overall temperature of a liquid discharging head, there is almost no reduction in the difference in temperature among liquid discharging heads. Supposing a very large amount of liquid is circulated through the liquid discharging head, the difference in temperature among the liquid discharging heads can be reduced, but this needs a large pump, leading to an increase in the size of the liquid discharge apparatus and an increase in the production cost and running cost.

SUMMARY OF THE INVENTION

The present invention provides a liquid discharging head including a support member and plural print element substrates through which a liquid is discharged. The print element substrates are disposed on the support member and provided with the liquid through a liquid supply channel formed in the support member. The sectional area of the liquid supply channel at a position corresponding to each of the print element substrates is determined in accordance with an order in which the print element substrates are provided with the liquid.

Further features of the present invention will become apparent from the following description of exemplary embodiments with reference to the attached drawings.

DESCRIPTION OF THE EMBODIMENTS

An embodiment of a liquid discharging head according to the present invention will hereinafter be described in detail with reference to the drawings. The basic structure and the action of the liquid discharging head in the embodiment will be first described with reference to FIG. 1 to FIG. 4. In the embodiment, a liquid discharging head used in a full-line-type ink jet printing apparatus (liquid discharge printing apparatus) that continuously feeds a recording medium and discharges liquid ink to the recording medium to print an image will be described by way of example.

Figure 1:
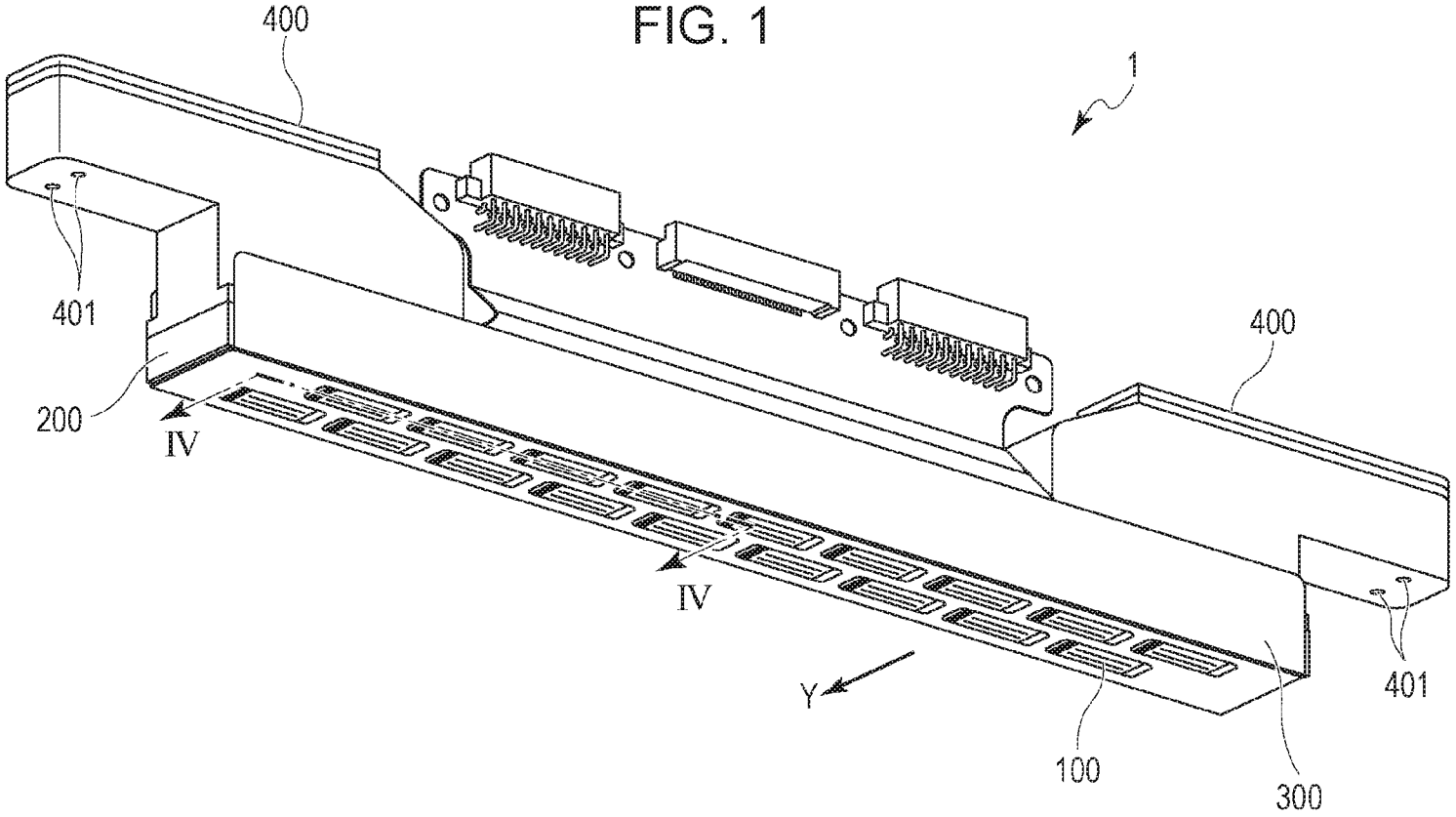
FIG. 1 is a perspective view of an embodiment of a liquid discharging head according to the present invention.
Figure 2:
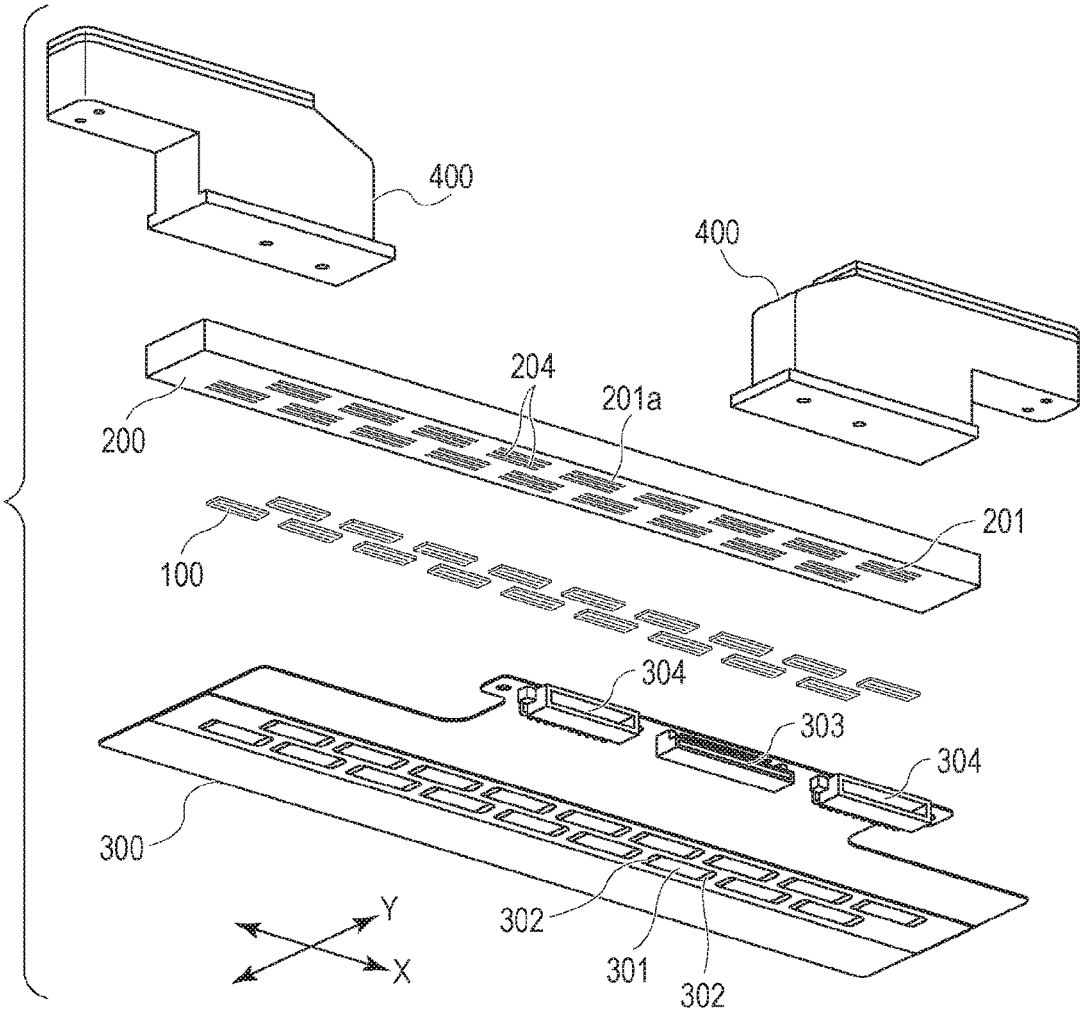
FIG. 2 is an exploded perspective view of the liquid discharging head shown in FIG. 1.
Figure 3A:
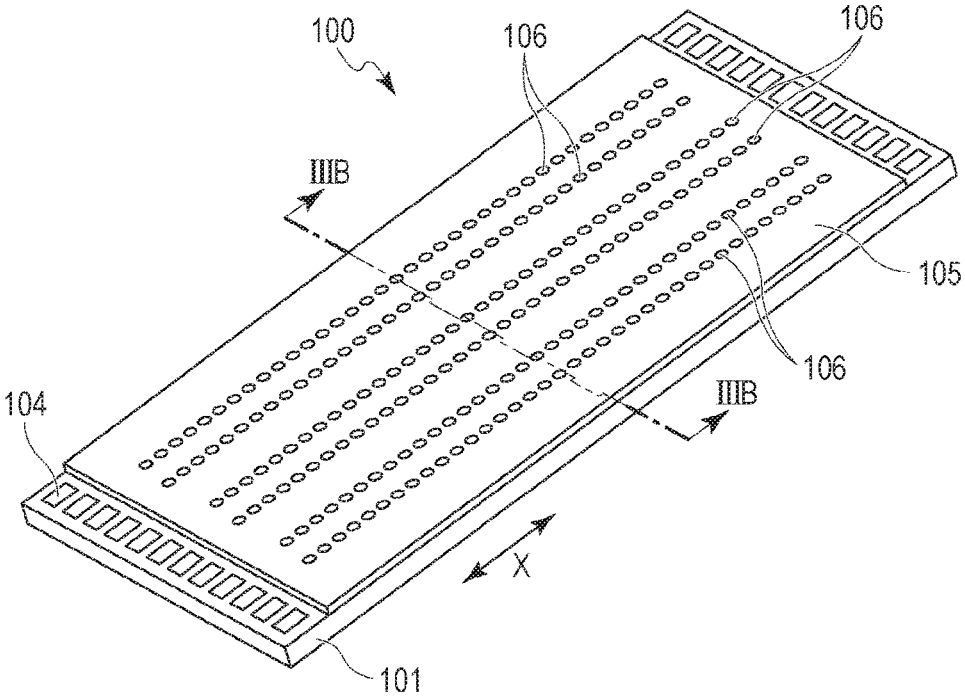
FIG. 3A and FIG. 3B show the structure of a print element substrate shown in FIG. 1.
Figure 3B:
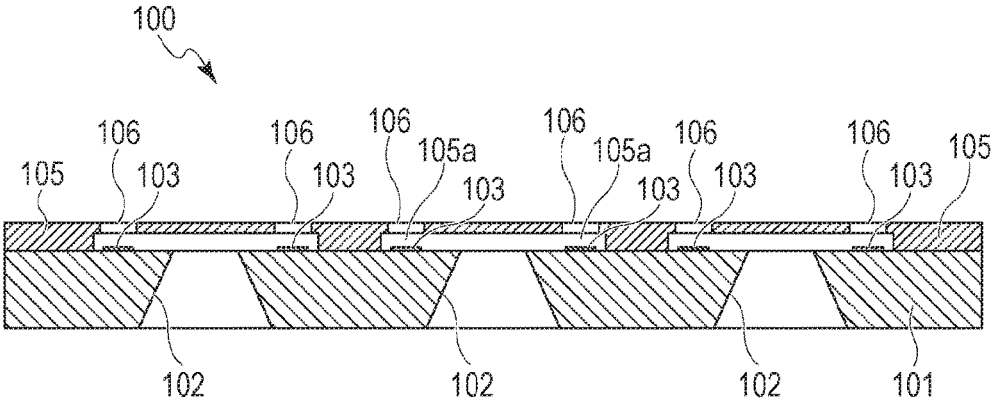
Figure 4:
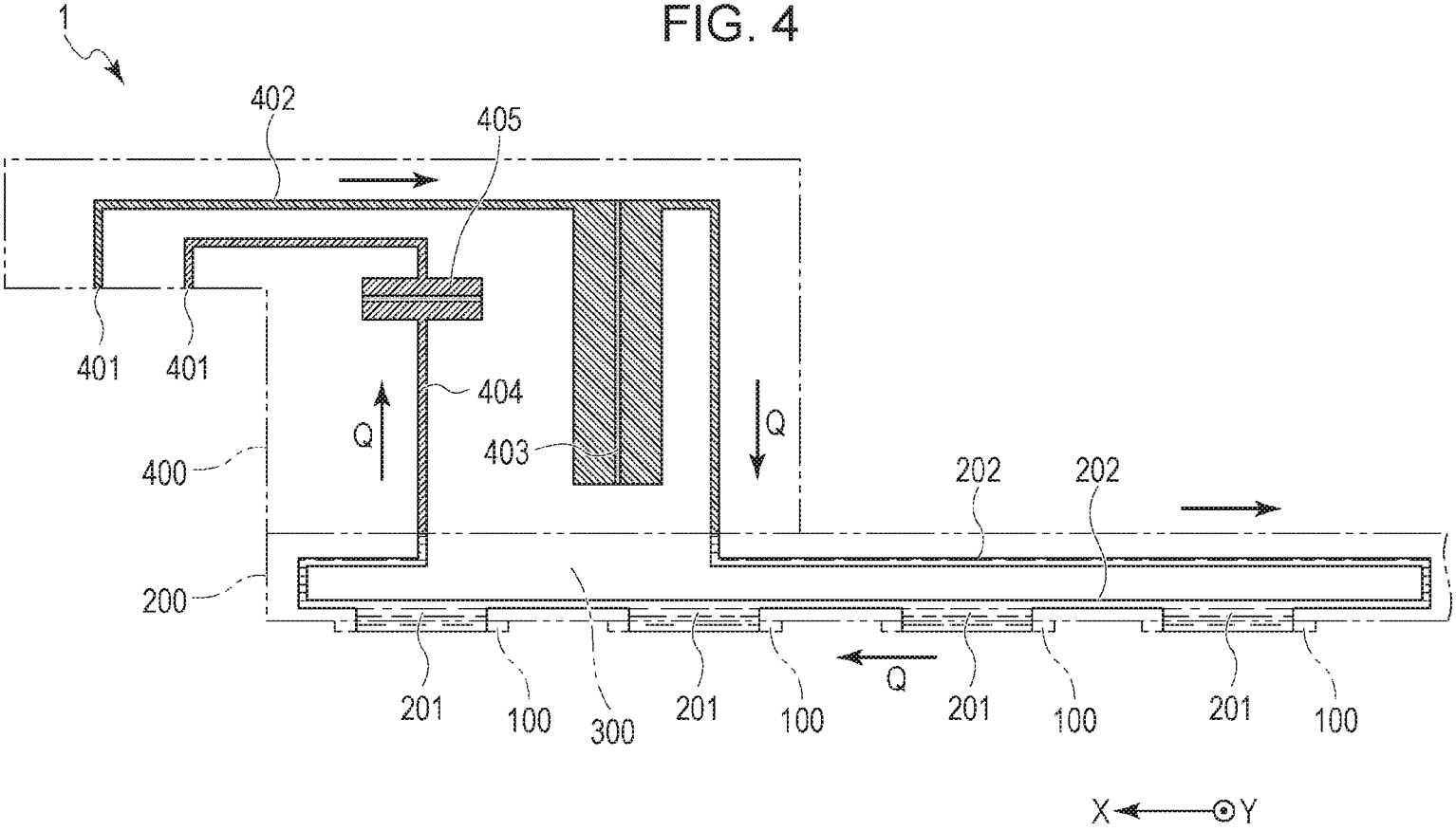
FIG. 4 is a schematic diagram of the channel structure of the liquid discharging head shown in FIG. 1.

FIG. 1 and FIG. 2 are a perspective view and an exploded perspective view of a liquid discharging head 1 in the embodiment. FIG. 3A is a perspective view showing the structure of a print element substrate provided in the liquid discharging head. FIG. 3B is a sectional view along line IIIB-IIIB in FIG. 3A. FIG. 4 is a schematic view of the channel structure of the liquid discharging head 1 shown in FIG. 1.

As shown in FIG. 1 and FIG. 2, the liquid discharging head 1 in the embodiment includes print element substrates 100, a support member 200, an electric wiring component 300, and a liquid supplying member 400.

The support member 200 is made of silicon and formed into a rectangular parallelepiped. The size of the support member 200 in the longitudinal direction is longer than the width of the recording medium (length in the direction X perpendicular to the direction Y in which the recording medium is fed in the liquid discharge printing apparatus). The support member 200 secures the print element substrates 100 and supplies a liquid to the print element substrates 100. Liquid introduction ports 201 through which the liquid is supplied to the print element substrates are formed in the surface of the support member 200. A main channel 202 (liquid supply channel) that communicates with the liquid supplying member 400, which is described later, is formed in the interior of the support member 200 and the liquid is introduced into and discharged from the main channel 202 (see FIG. 4). The main channel 202 is a shared channel that communicates with the print element substrates 100. The liquid is supplied to the print element substrates 100 via the liquid introduction ports 201 in order. The supply begins with the print element substrate 100 provided on the most upstream side in the supply direction. In the embodiment, the liquid introduction ports 201 of the support member 200 are defined as three oblong openings by beams 204 (two beams in the figure) provided in parallel with the longitudinal direction of the support member 200. The support member 200, for example, can be integrally formed by stacking alumina green sheets and firing the stacked sheets.

Each print element substrate 100 includes a silicon substrate 101 and a discharge-port defining member 105 joined to the silicon substrate 101. Supply ports 102 are formed in the silicon substrate 101 along the longitudinal direction of the silicon substrate 101 (direction X in FIG. 3A) so as to communicate with the respective liquid introduction ports 201 formed in the support member 200. The discharge-port defining member 105 is bonded to one surface of the silicon substrate 101. In the discharge-port defining member 105, discharge ports are arranged in a zigzag formation so as to be on either side of each supply port 102 formed in the silicon substrate 101. A group of the discharge ports arranged in the zigzag formation corresponds to a row of the discharge ports. There are three rows of the discharge ports in each print element substrate 100. The number of the rows of the discharge ports formed in each print element substrate 100 can be determined optionally in accordance with specifications required for the liquid discharging head 1.

Heat-generating resistance elements 103, which are energy-generating elements that generate energy used to discharge a liquid, are disposed on one surface of the silicon substrate 101 so as to face the respective discharge ports. The heat-generating resistance elements 103 are driven by a driving circuit of the liquid discharge printing apparatus, which is not shown, in order to generate thermal energy. This thermal energy results in film boiling of the liquid supplied to the interior of liquid passages 105*a* (see FIG. 3B), and a variation in pressure that occurs at this time causes the liquid to be discharged from the discharge ports 106. At both ends of each print element substrate 100 in the longitudinal direction (direction X), electrodes 104 that are electrically connected to the electric wiring component 300 are formed. The heat-generating resistance elements 103 are connected to the electrodes 104 by wiring such as aluminum wiring.

The print element substrates 100 configured as above are arranged in a zigzag formation such that some print element substrates overlap each other when viewed in a direction perpendicular to the direction in which the recording medium is fed (direction Y). This arrangement enables a recording width of approximately 13 to 20 inches to be achieved in the embodiment.

The electric wiring component 300 supplies, to the print element substrates 100, driving signals and a driving power transferred from the liquid discharge apparatus. The electric wiring component 300 is provided with plural openings 301 in order to incorporate the print element substrates 100 and electrodes 302 (see FIG. 2) corresponding to the electrodes 104 (see FIG. 3A) of the print element substrates 100. The electrodes 104 and the electrodes 302 are electrically connected to each other by, for example, wire bonding. The junction of these electrodes is sealed and protected by a sealant. The electric wiring component 300 is also provided with input terminals 303, 304 through which control signals and an electric power are supplied from the liquid discharge printing apparatus to the electric wiring component 300.

The liquid supplying member 400 connects a liquid storage member provided in the liquid discharge printing apparatus to the support member 200 and is made of a resin by injection molding. In the interior of the liquid supplying member 400, as shown in FIG. 4, channels 402, 404 are formed and filters 403, 405 that collect dust etc., are disposed on the channels. The liquid supplying member 400 is liquid-tightly secured to the support member 200 such that one end of the channel 402 and one end of the channel 404 are connected to the respective ends of the main channel 202 of the support member 200. In this state, a circulating channel through which the liquid is circulated is formed such that the liquid that leaves the liquid storage member of the liquid discharge printing apparatus reaches the liquid storage member again via the channel 402 of the liquid supplying member 400, the main channel 202 of the support member 200, and the channel 404 of the liquid supplying member 400. Some of the liquid supplied to the support member 200 in the circulating channel is supplied to the liquid passages 105*a* of the print element substrates. The liquid is heated by heat generated by the heat-generating resistance elements 103 and is discharged from the discharge ports.

Thus, the heat generated by the heat-generating resistance elements 103 of the liquid discharging head 1 is transferred to the liquid in the liquid passages 105*a* and the support member 200 that supports the print element substrates 100. The heat transferred to the support member 200 is transferred to the liquid flowing through the main channel 202 and the support member 200 is cooled. The liquid discharging head is maintained at an appropriate temperature when the heat is thus transferred. However, when the calorific value per unit time is large, e.g., when high speed printing is performed, the heat generated in the print element substrates cannot be sufficiently dissipated, and a difference in temperature occurs in the interior of each print element substrate 100 or a difference in temperature occurs among the print element substrates 100. In the liquid discharging head 1, such a difference in temperature causes a difference in the amount of liquid to be discharged, thereby causing a variation in the contrast of images to be printed.

Figure 18A:
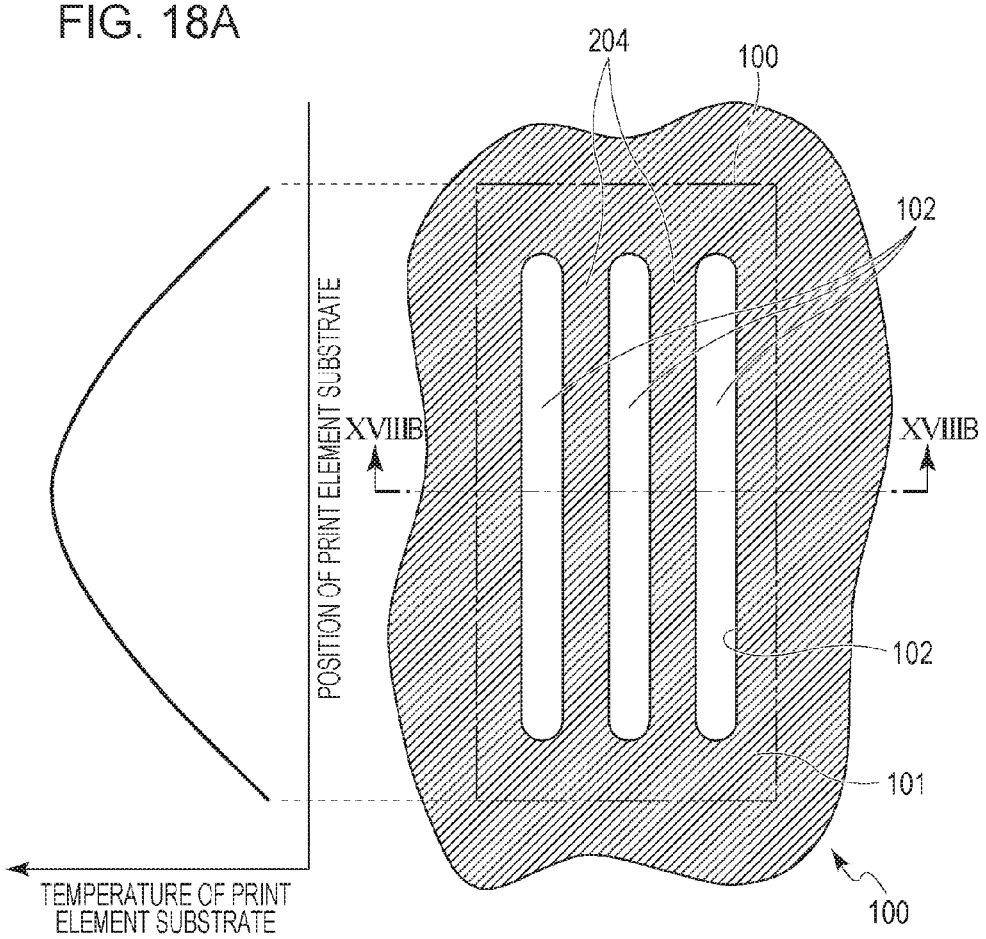
FIGS. 18A and 18B show the relationship between the position and the temperature of a print element substrate in the related art.
Figure 18B:
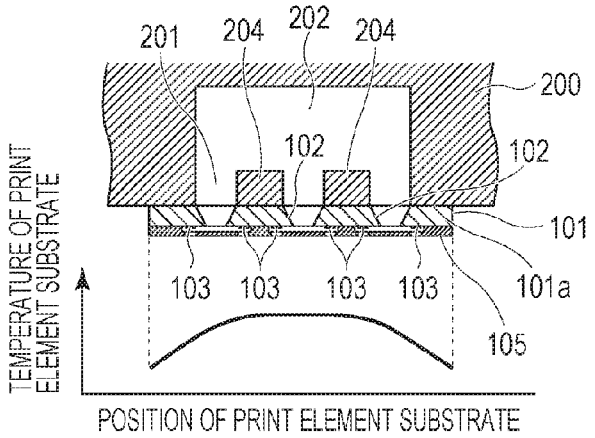

The difference in temperature that occurs in each print element substrate will be described in more detail with reference to FIG. 18A and FIG. 18B. FIG. 18A and FIG. 18B are diagrams showing a state where the difference in temperature occurs in the print element substrate. FIG. 18A shows a temperature distribution of the print element substrate in the longitudinal direction (direction X). FIG. 18B shows a temperature distribution of the print element substrate in the lateral direction (direction Y). In FIG. 18A and FIG. 18B, a region of each liquid introduction port 201 is put between the beams 204. Accordingly, although part of the heat generated by the heat-generating resistance elements 103 is transferred to the support member 200, the direction in which the heat is transferred is limited to the longitudinal direction (direction X in FIG. 18A). For this reason, as shown in FIG. 18B, the temperature of the beams 204 is higher than the temperature of outer regions 101*a* outside each liquid introduction port 201 when the calorific value is increased due to, for example, high speed printing and cooling by the liquid is insufficient. In the beams 204, as shown in FIG. 18A, a central portion thereof in the longitudinal direction has the highest temperature. When the temperature of the support member 200 is increased, it is difficult to transfer the heat in the print element substrates 100 to the support member 200. Thus, the print element substrates 100 have temperature distributions in both the lateral direction and the longitudinal direction as shown in FIG. 18A and FIG. 18B.

The difference in temperature that occurs among the print element substrates 100 of the liquid discharging head 1 will be next described in more detail. In the circulating channel through which the liquid is supplied, the liquid has a relatively low temperature right after the liquid flows into the support member 200 from the liquid supplying member 400 (this liquid is referred to as a liquid on the upstream side below). For this reason, it is easy to cool a portion of the support member 200 and the print element substrates 100 that are located on the upstream side in the main channel 202 of the support member 200. In contrast, it is difficult to cool some of the print element substrates 100 that are located on the downstream side, because the temperature of the liquid is gradually increased due to the heat transferred from the other print element substrates 100 as the liquid flows to the downstream side of the main channel 202. The difference in temperature consequently occurs between the print element substrates 100 located on the upstream side and the print element substrates 100 located on the downstream side.

When the calorific value per unit time is increased due to increased recording speed, an increased length of the liquid discharging head, or other reasons, large differences in temperature occur in each print element substrate and among the print element substrates. These differences in temperature cannot be reduced by merely increasing the flow rate of the liquid in the liquid discharging head. In particular, the difference in temperature among the print element substrates is hardly reduced, although the increase in the flow rate of the liquid reduces the overall temperature. Supposing a very large amount of liquid is circulated, the difference in temperature can be reduced, but this requires that the liquid discharge apparatus be equipped with a large pump, leading to an increase in the size and the cost of the liquid discharge apparatus. In view of this, a first embodiment of the present invention has the features described below.

First Embodiment

Figure 5:
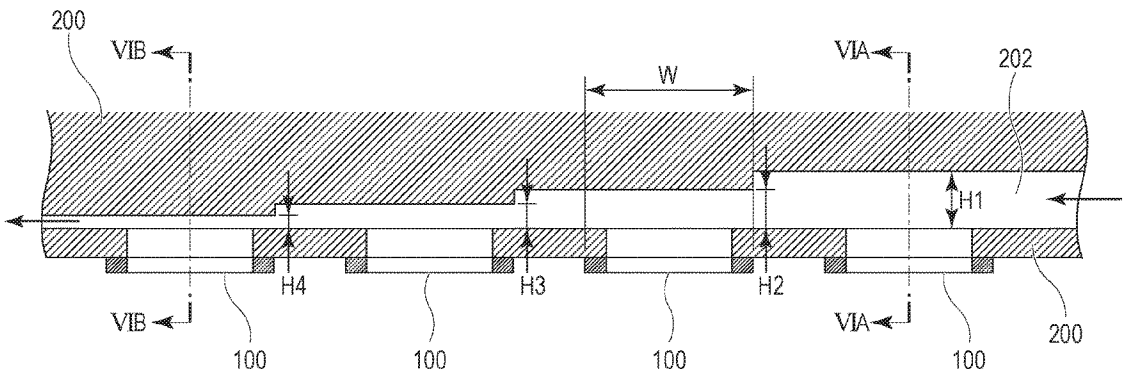
FIG. 5 is a sectional view of the channel structure of a liquid discharging head in a first embodiment.
Figure 6A:
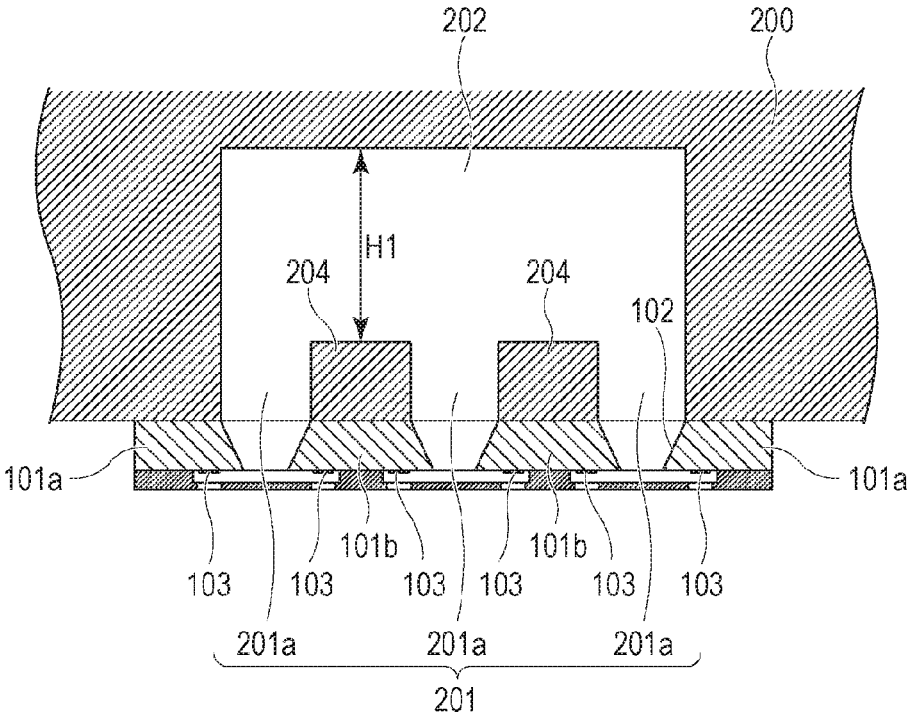
FIG. 6A and FIG. 6B are a sectional view along line VIA-VIA and a sectional view along line VIB-VIB that are shown in FIG. 5, respectively.
Figure 6B:
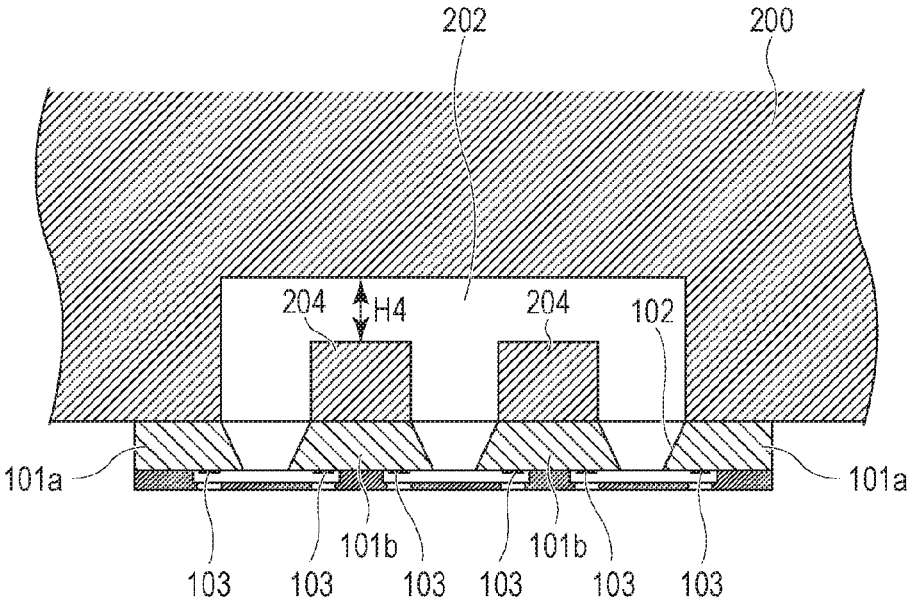

The features of the first embodiment of a liquid discharging head according to the present invention will be described with reference to FIG. 5, FIG. 6A and FIG. 6B. FIG. 5 is a sectional view of the channel structure of the liquid discharging head in the embodiment and shows section IV-IV in FIG. 1. FIG. 6A is a sectional view along line VIA-VIA in FIG. 5. FIG. 6B is a sectional view along line VIB-VIB in FIG. 5.

In the embodiment, a portion of the main channel 202, which is formed in the support member 200, that corresponds to each print element substrate 100 has a cross-sectional area (sectional area of the channel) that varies depending on the position of the portion of the main channel 202. More specifically, the portion of the main channel 202 that corresponds to each print element substrate 100 has a smaller sectional area as the portion is nearer to the most downstream position. The sectional area of the channel is determined in accordance with the height H (referred to as the height of the main channel below) of the upper surface (second inner surface) of the main channel from the bottom surface (first inner surface) of the main channel. Accordingly, the height of the main channel 202 at the positions corresponding to the print element substrates located on the upstream side is determined to be lower than the height of the main channel 202 on the downstream side. In other words, the sectional area of the main channel 202 at the positions corresponding to the print element substrates located on the downstream side is smaller than the sectional area of the main channel 202 at the positions corresponding to the print element substrates located on the upstream side. In an example shown in the figures, the relation $H1 \geq H2 \geq H3 \geq H4$ ($H1 > H4$) holds, where the height H of the main channel 202 is denoted by H1, H2, H3, and H4 in order starting from the upstream side. As shown in FIG. 5, the heights H1, H2, H3, and H4 of the main channel represent average heights of the channel in sections having a width W that are located above the print element substrates 100. The specific value of the height H ranges from 0.5 to 5 mm.

In contrast, when the height of the main channel formed in the support member is constant such as in the case of a liquid discharging head that is conventionally used, the temperature of the liquid gradually increases as the liquid flows from the downstream side to the upstream side of the main channel 202. Consequently, transfer of heat from a downstream portion of the beams 204 of the support member 200 to the liquid is more difficult than that from the other portions of the beams 204, and the temperature of the print element substrates 100 is increased at this portion. In the embodiment, however, the height of the main channel 202 at the position corresponding to each print element substrate is further reduced as the position is nearer to the most downstream position and the main channel 202 at this position has a smaller sectional area. Accordingly, the speed of the liquid flowing through the main channel 202 is further increased as the liquid flows to the downstream side, and the temperature of the liquid is inhibited from increasing. The amount of heat transferred from the beams 204 to the liquid is consequently increased compared with when the sectional area of the main channel 202 is constant, and the difference between the amount of heat transferred from the beams 204 on the upstream side to the liquid and the amount of heat transferred from the beams 204 on the downstream side to the liquid is reduced. Accordingly, in the embodiment, the difference in temperature among the print element substrates and the difference in temperature in each print element substrate can be reduced without circulating a very large amount of liquid with a large pump. The variation in the amount of liquid discharged from the discharge ports can thereby be reduced and the variation in the contrast of images to be printed can be reduced.

In the embodiment, the height H of the main channel 202 ranges approximately from 0.5 to 5 mm. The height of the main channel 202, however, can be determined optionally in accordance with the calorific value of the print element substrates 100, and the temperature and the flow rate of the circulating liquid. In the embodiment, the support member 200 is made of alumina formed by stacking green sheets. For this reason, the height is changed in a manner in which the section of the main channel 202 in the longitudinal direction is in the form of steps in this embodiment. However, when the support member is made of another material and by another method, the main channel may be formed so as to have a tapered section so that the height is continuously reduced from the upstream side to the downstream side.

Second Embodiment

Figure 7:
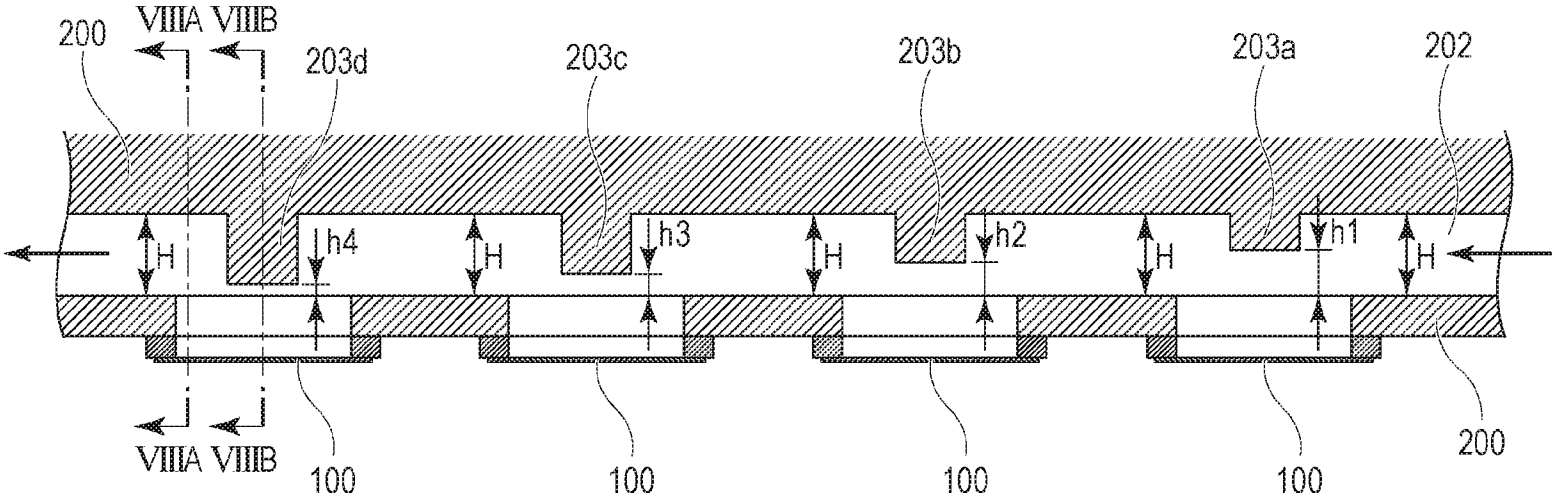
FIG. 7 is a sectional view of the channel structure of a liquid discharging head in a second embodiment.
Figure 8A:
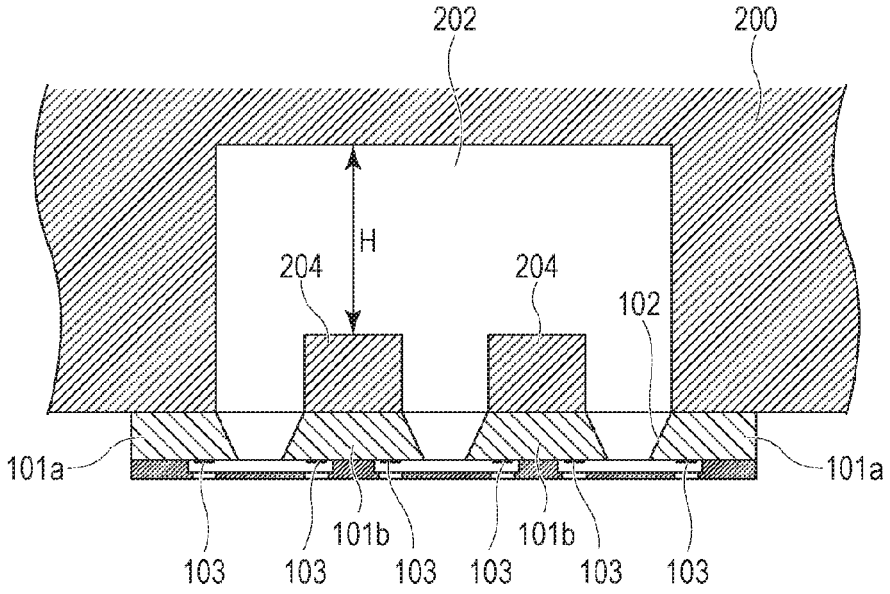
FIG. 8A and FIG. 8B are a sectional view along line VIIIA-VIIIA and a sectional view along line VIIIB-VIIIB that are shown in FIG. 7, respectively.
Figure 8B:
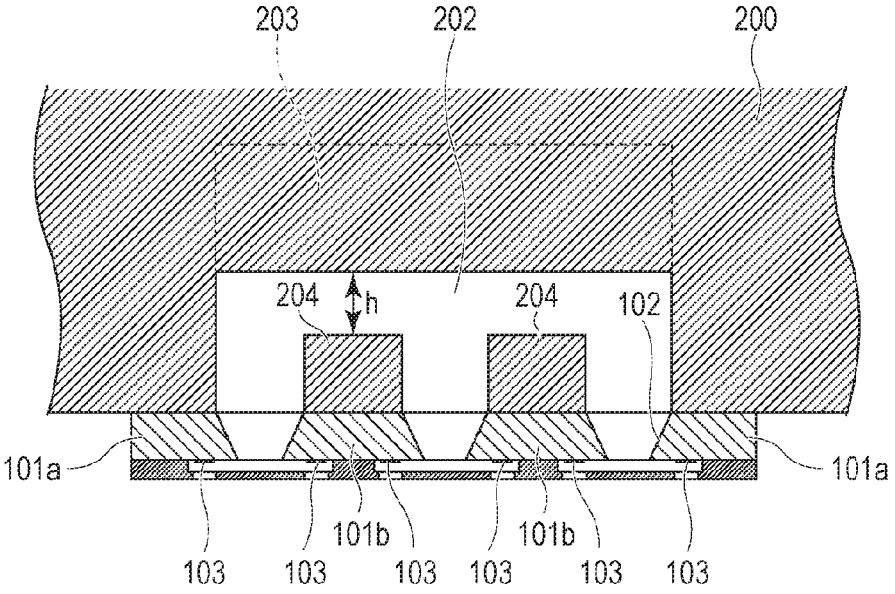

A second embodiment of a liquid discharging head according to the present invention will be next described with reference to FIG. 7, FIG. 8A, and FIG. 8B. FIG. 7 is a sectional view of the channel structure of the liquid discharging head and corresponds to section IV-IV in FIG. 1. FIG. 8A is a sectional view along line VIIIA-VIIIA in FIG. 7. FIG. 8B is a sectional view along line VIIIB-VIIIB in FIG. 7. The second embodiment has the same features as in FIG. 1 to FIG. 4. In FIG. 7, FIG. 8A, and FIG. 8B, like symbols designate components like or corresponding to those in the first embodiment and a detailed description for these components is omitted.

In the liquid discharging head in the second embodiment, the distance between the upper surface (second inner surface) and the bottom surface (first inner surface) of the main channel 202 of the support member 200, that is, the height of the main channel 202 is constant. However, projections 203*a* to 203*d* extending toward the liquid introduction ports 201 are formed on the upper surface of the main channel 202 so as to face the central portion of the respective print element substrates 100. The distance h between the lower end of the projections 203*a* to 203*d* and the lower surface of the main channel varies. More specifically, the distance h between the lower surface of the main channel and the projections that face the print element substrates located on the downstream side is equal to or shorter than the distance h between the lower surface of the main channel and the projections that face the print element substrates located on the upstream side. In an example shown in the figures, the relation H>h1≥h2≥h3≥h4 (h1>h4) holds, where the height of the main channel 202 is denoted by H, and the distance between each projection 203 and each beam 204 is denoted by h1, h2, h3, and h4 in order starting from the upstream side. The symbol H represents the distance between the upper surface and the bottom surface of the main channel. In FIG. 8A and FIG. 8B, the symbol 101*a* represents regions of the silicon substrate 101 that are located outside the supply ports 102. The outer regions 101*a* are joined to a surface of the support member 200 (lower surface in the figure) that is located outside the main channel 202. The symbol 101*b* represents regions of the silicon substrate 101 that are located between the supply ports 102. The inner regions 101*b* are joined to the beams 204 provided within the main channel 202.

Figure 17:
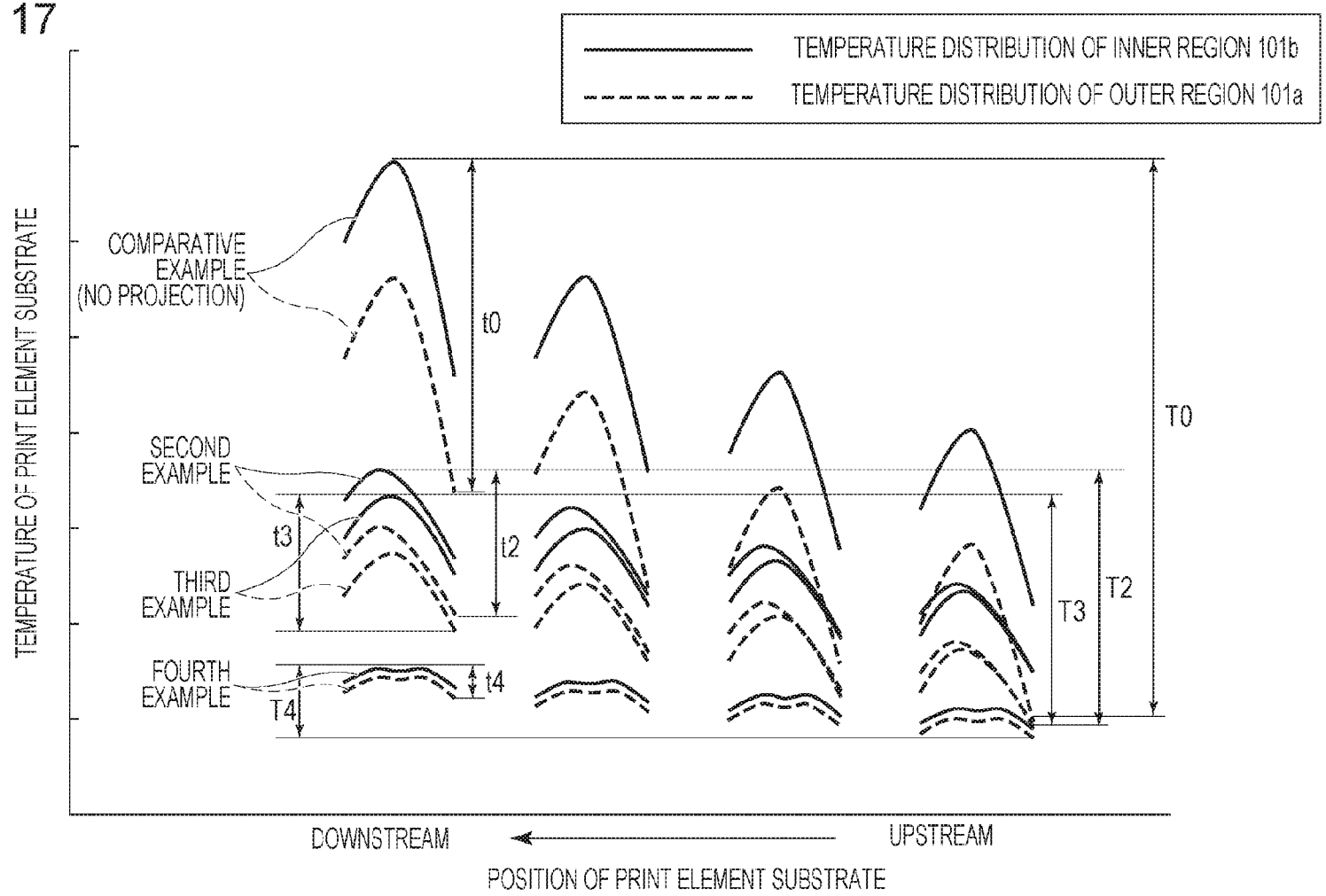
FIG. 17 is a chart showing the relationship between the position and the temperature of print element substrates.

FIG. 17 is a chart showing the relationship between the position and the temperature of the print element substrates 100 when the embodiments of the present invention are applied and a comparative example is applied, and in the comparative example, no projection is formed on the upper surface of a main channel and the distance between the upper surface and the bottom surface of the main channel is constant. In FIG. 17, dashed lines represent the temperature distributions of the outer regions 101*a* of the print element substrates 100 in the longitudinal direction, and solid lines represent the temperature distributions of the inner regions 101*b* of the print element substrates 100 in the longitudinal direction. In this embodiment, the speed of the flowing liquid can be increased at the positions at which the projections 203 (203*a* to 203*d*) are provided, and the beams 204 located at a central portion, whose temperature is likely to increase, can be intensively cooled. Consequently, the difference t2 in temperature that occurs in each print element substrate 100 in this embodiment can be made smaller than the difference t0 in temperature that occurs in each print element substrate 100 in the comparative example, in which the projection 203 is not provided. The differences t2, t0 shown in the figure represent a difference between the maximum temperature and the minimum temperature of the print element substrates 100.

Since the distances between the projections 203 and the beams 204 on the downstream side are smaller than on the upstream side, the difference T2 in temperature among the print element substrates 100 is reduced as in the first embodiment. The difference T2 in temperature shown in the figure represents a difference between the minimum temperature of the print element substrate located most upstream and the maximum temperature of the print element substrate located most downstream.

In this way, the variation in the amount of liquid discharged through the print element substrates is reduced, so that the variation in the contrast of images hardly occurs and the printing can be performed with a high quality, when the calorific value is increased due to high speed printing, or when the length of the liquid discharging head is further increased.

In the second embodiment, the distance H between the upper surface and the bottom surface of the main channel 202 (or the height) ranges approximately from 3 to 10 mm, and the distance h between the beams 204 and the print element substrates 100 ranges approximately from 0.5 to 5 mm. The values of H and h, however, can be determined optionally in accordance with the calorific value of the print element substrates 100, and the temperature and the flow rate of the circulating liquid as in the first embodiment.

Figure 9:
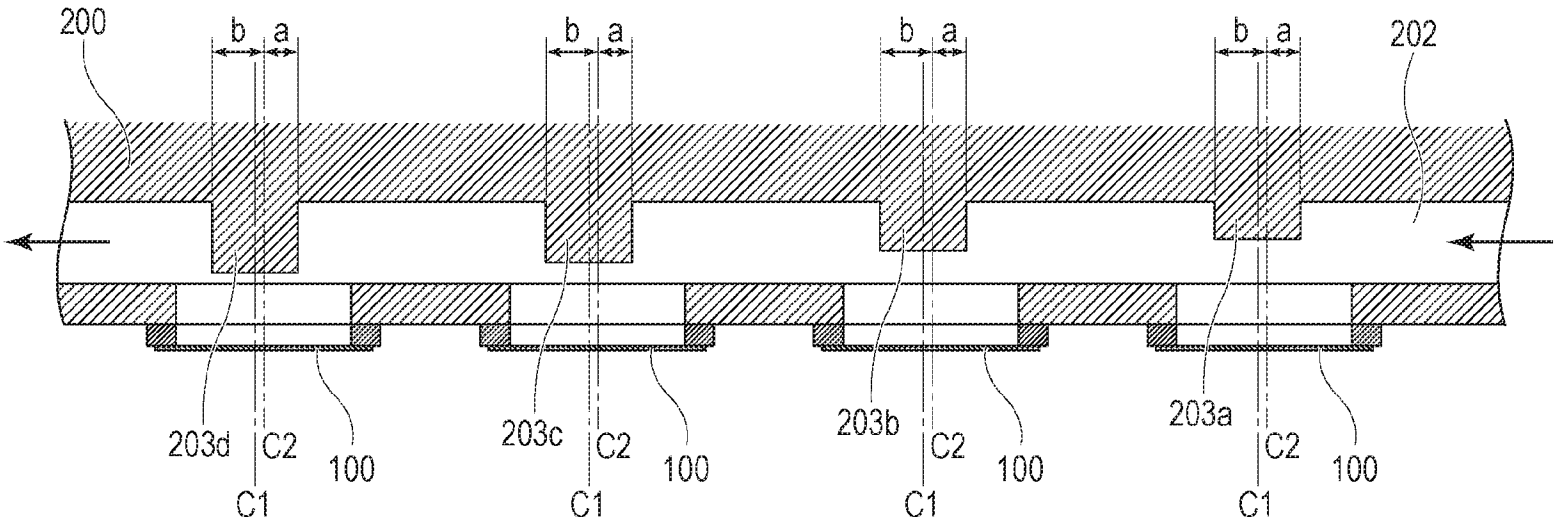
FIG. 9 is a sectional view of a modification of the channel structure in the second embodiment.

As shown in FIG. 9, the center C1 of each projection 203 in the longitudinal direction may be slightly apart from the center C2 of the corresponding print element substrate 100 in the longitudinal direction (direction Y) toward the downstream side. In other words, the distance b between a vertical line passing through the center C2 of each print element substrate 100 and the downstream side face of the corresponding projection 203 is longer than the distance a between the vertical line passing through the center C2 and the upstream side face of the corresponding projection 203 (the relation a<b holds).

With this structure, the region at which the speed of the flowing liquid is increased due to the projections 203 spreads toward the downstream side, the maximum temperature of the print element substrates in the longitudinal direction can be further decreased, and the difference t2 in temperature in each print element substrate 100 can be further reduced.

Third Embodiment

Figure 10:
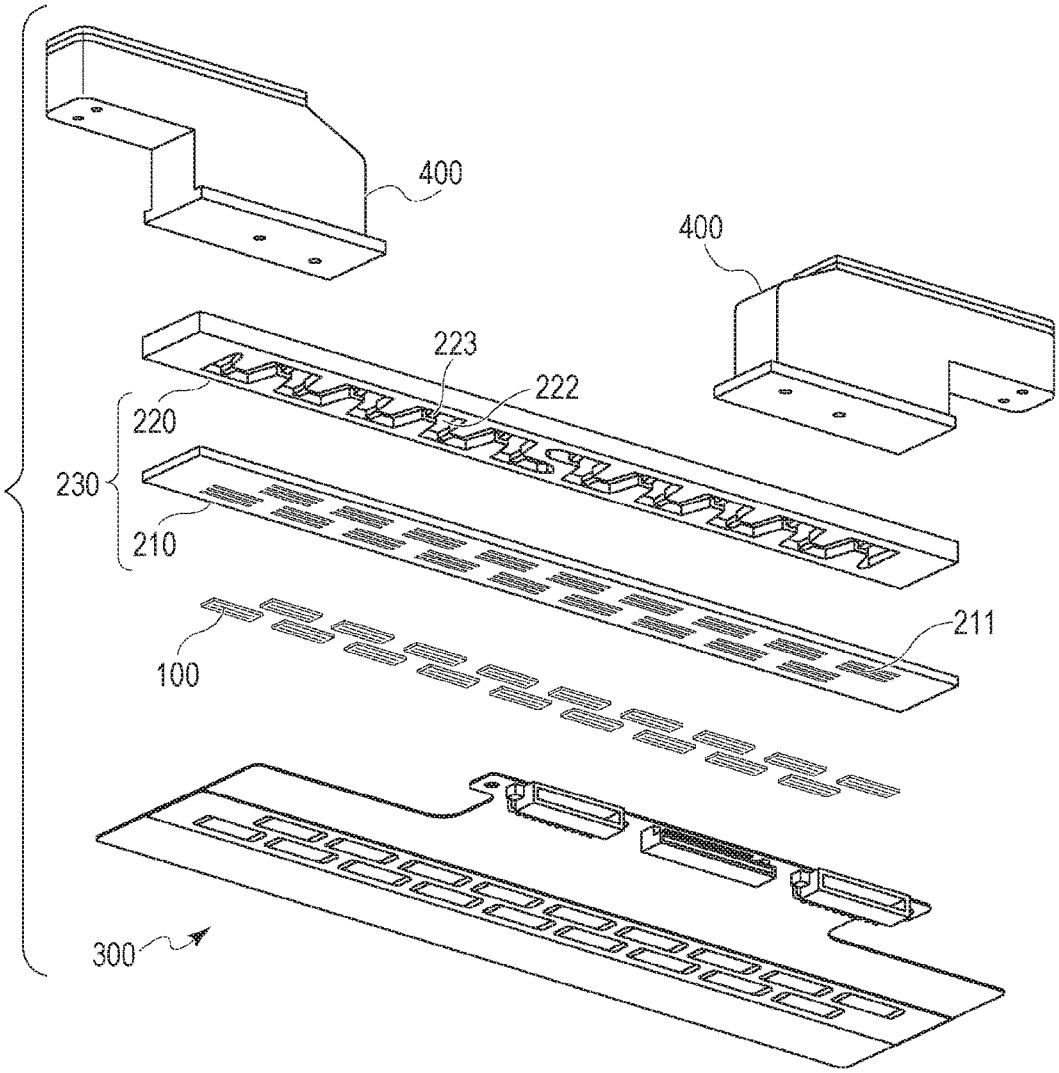
FIG. 10 is an exploded perspective view of a liquid discharging head in a third embodiment.
Figure 11:
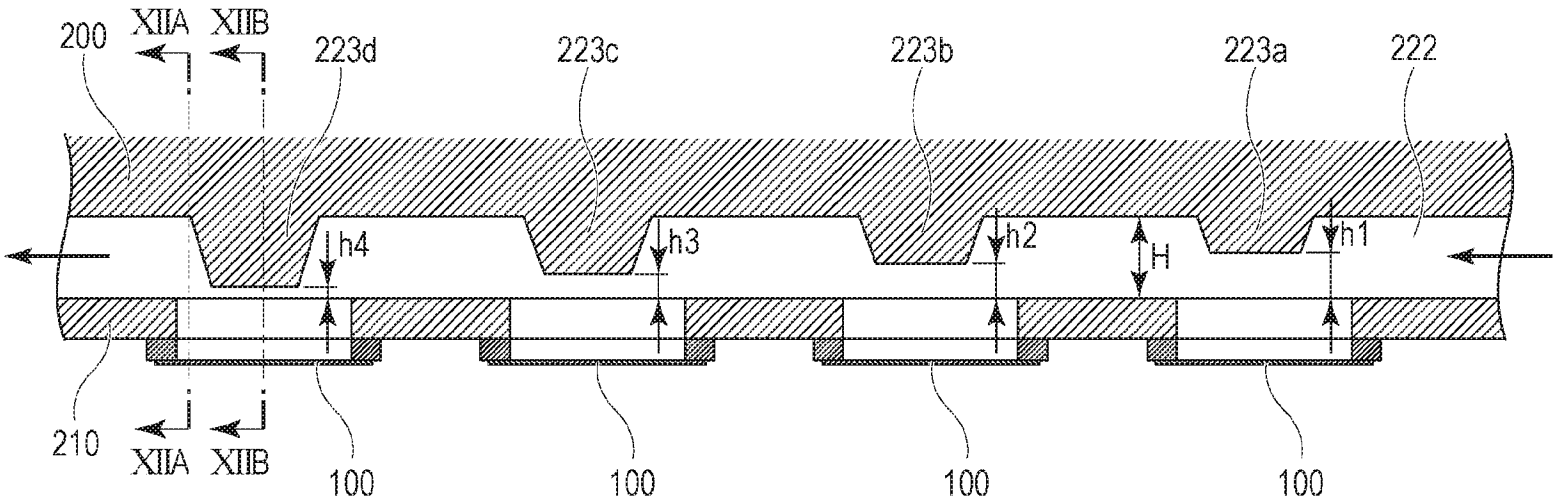
FIG. 11 is a sectional view of the channel structure of the liquid discharging head in the third embodiment.
Figure 12A:
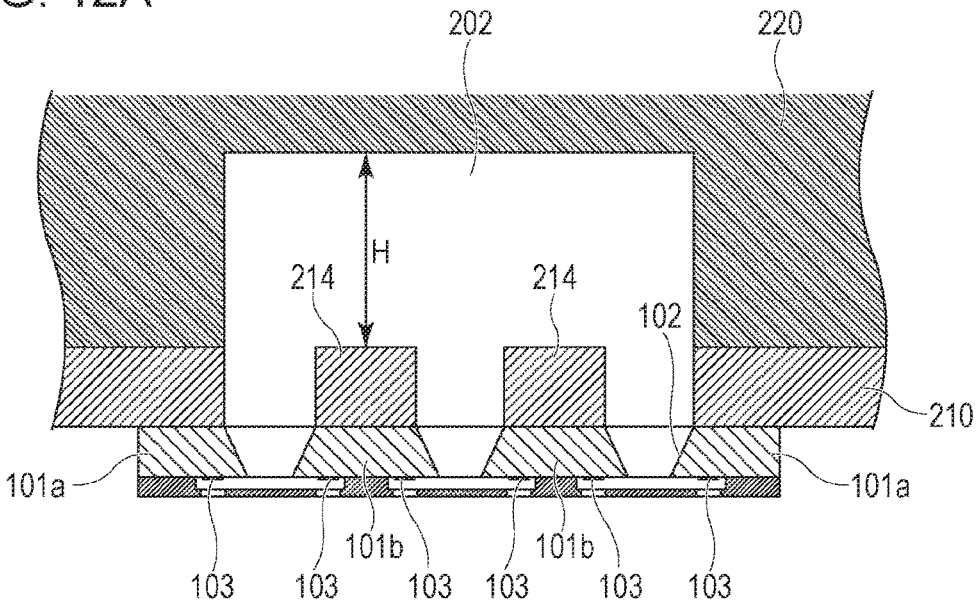
FIG. 12A and FIG. 12B are a sectional view along line XIIA-XIIA and a sectional view along line XIIB-XIIB that are shown in FIG. 11, respectively.
Figure 12B:
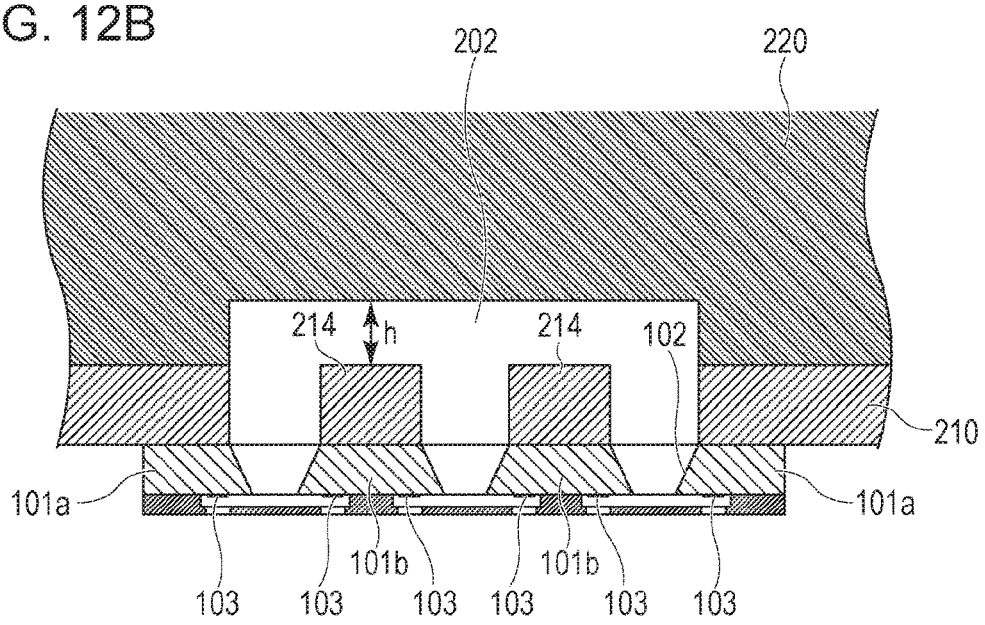

A third embodiment of the present invention will be next described with reference to FIG. 10 to FIG. 12B. FIG. 10 is an exploded perspective view of a liquid discharging head in the third embodiment. FIG. 11 is a sectional side view of part of the liquid discharging head 1 taken in the longitudinal direction. FIG. 12A is a sectional view along line XIIA-XIIA in FIG. 11. FIG. 12B is a sectional view along line XIIB-XIIB in FIG. 11. The third embodiment has the same features as in FIG. 1 to FIG. 4. In FIG. 10 to FIG. 12B, like symbols designate components like or corresponding to those in the first embodiment and a detailed description for these components is omitted.

In this embodiment, as shown in FIG. 10, a support member 230 includes a support portion 210 that supports and secures the print element substrates 100 and a channel portion 220 having a groove that serves as the main channel 202. The support portion 210 is made of a material having a relatively low linear expansion coefficient and a relatively high thermal conductivity such as alumina, Ti, SUS, or a resin containing a filler. The volume of the support portion 210 that functions as a heat radiating portion may be determined in accordance with specifications required for the liquid discharging head 1 such that a minimum thermal capacity is achieved. The support portion 210 is preferably formed with a thickness of approximately 1 to 3 mm.

The channel portion 220 may be made of alumina as in the second embodiment, or a resin having a low linear expansion coefficient. When a resin is used for the channel portion, it is possible not only to greatly reduce its cost but also to increase the degree of freedom of its shape that is to be formed, for example, such that the sides of each projection 223 are tapered to suppress gathered air bubbles as shown in FIG. 11. Accordingly, in the third embodiment, the difference in temperature in each print element substrate 100 can be kept within t3, and the difference in temperature among the print element substrates 100 can be kept within T3, as shown in FIG. 17, and the thermal characteristics that can be achieved is as outstanding as the second embodiment. In addition, the degree of freedom of design and manufacture can be increased, and the cost and reliability can be further improved.

Figure 13:
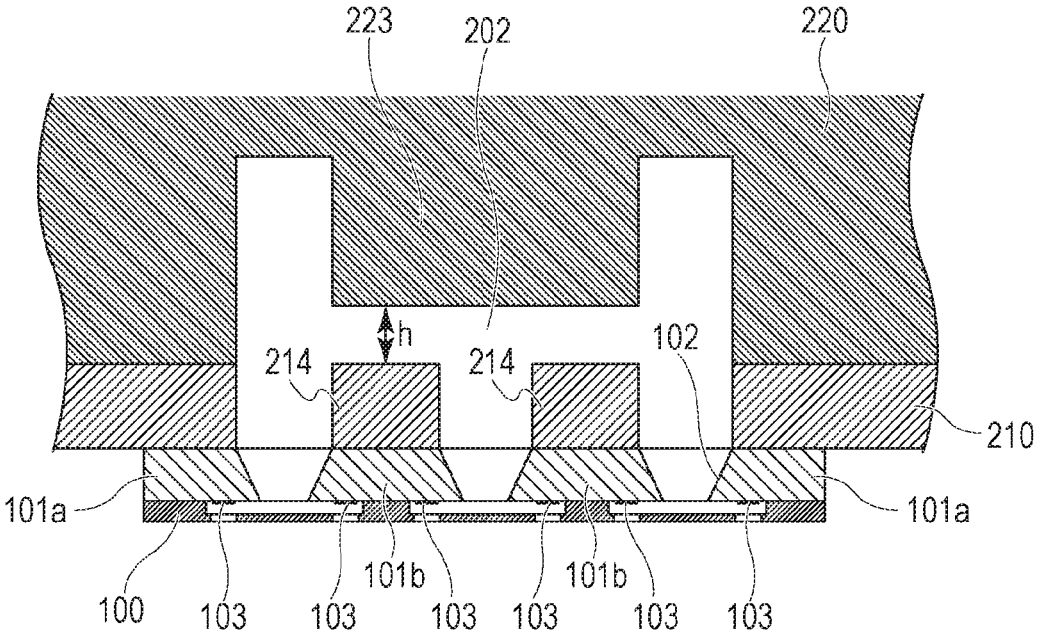
FIG. 13 is a sectional view of a modification of the channel structure in the third embodiment.

As shown in FIG. 13, the projections 223 may be formed at only positions corresponding to beams 214, whose temperature is likely to increase. This makes it easy to cool only the inner regions 101*b* of the print element substrates 100, enabling the difference in temperature between the outer regions 101*a* and the inner regions 101*b* to be further reduced.

Fourth Embodiment

Figure 14A:
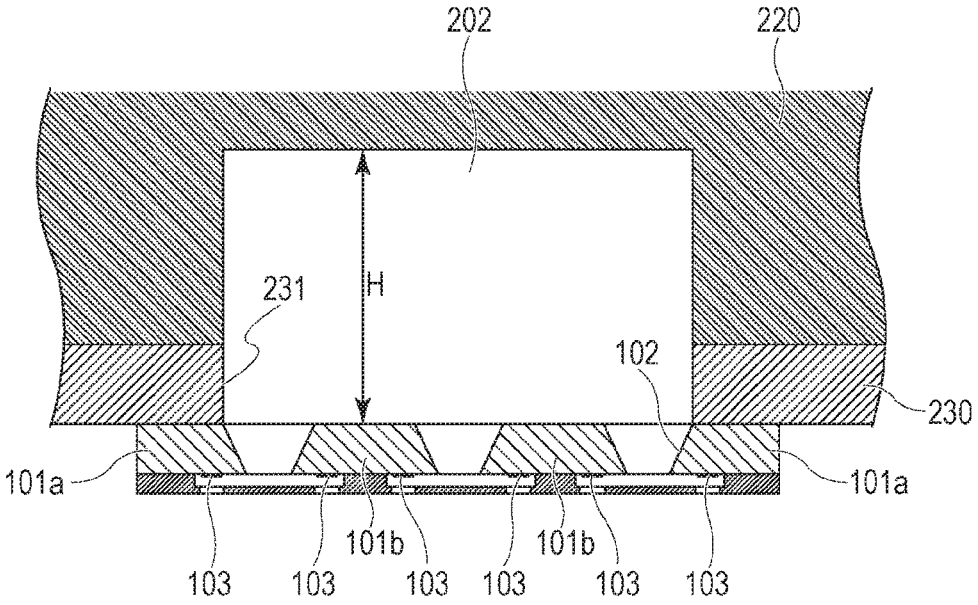
FIG. 14A and FIG. 14B are sectional views of the channel structure of a liquid discharging head in a fourth embodiment.
Figure 14B:
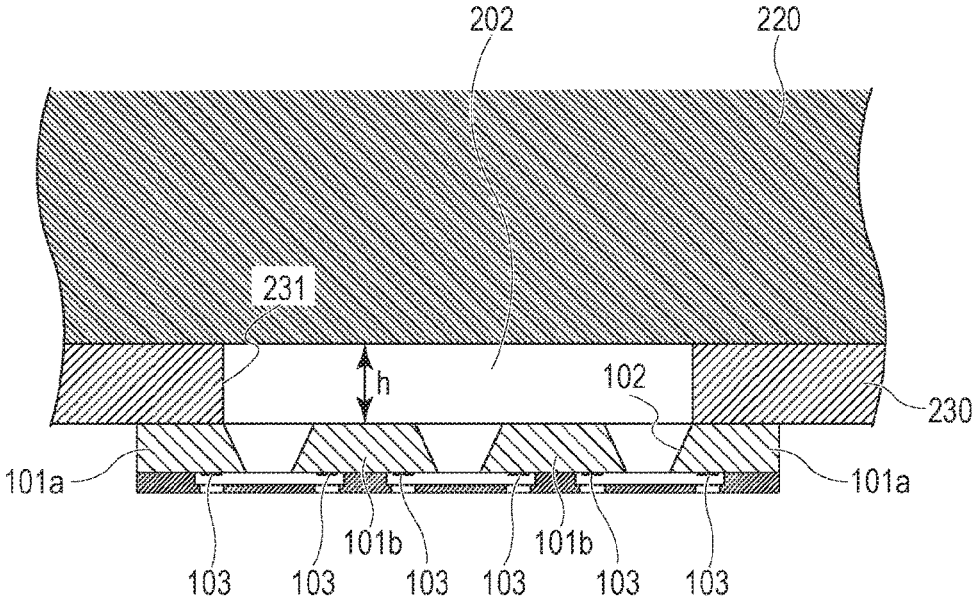

A fourth embodiment of the present invention will be next described with reference to FIG. 14A to FIG. 16B. The basic structure of the fourth embodiment is substantially the same as in the third embodiment except that, as shown in FIG. 14A and FIG. 14B, the beams are removed from the support portion 210 so that one surface (upper surface in the figure) of each print element substrate 100 is directly cooled by the circulating liquid in this embodiment.

Liquid introduction ports 231 through which a liquid is introduced into the print element substrates 100 are formed in the support portion 210. The support portion 210 is made of a material having a relatively low thermal conductivity such as borosilicate glass, zirconia, or a resin member with a thickness of approximately 0.5 to 3 mm. For this reason, in the fourth embodiment, it is difficult to transfer heat from the outer regions 101*a* to the support member 230, and the inner regions 101*b* come into direct contact with the liquid and thereby are efficiently cooled. Accordingly, as shown in FIG. 17, the difference in temperature between the outer regions 101*a* and the inner regions 101*b* of the liquid discharging head 1 is within the difference t4 in temperature, which is smaller than the difference t3 in temperature in the third embodiment. In addition, because the efficiency with which the inner regions 101*b* are cooled is improved, the difference in temperature among the print element substrates 100 can be reduced to within the difference T4 in temperature, which is smaller than the difference T3 in temperature in the third embodiment.

Figure 15:
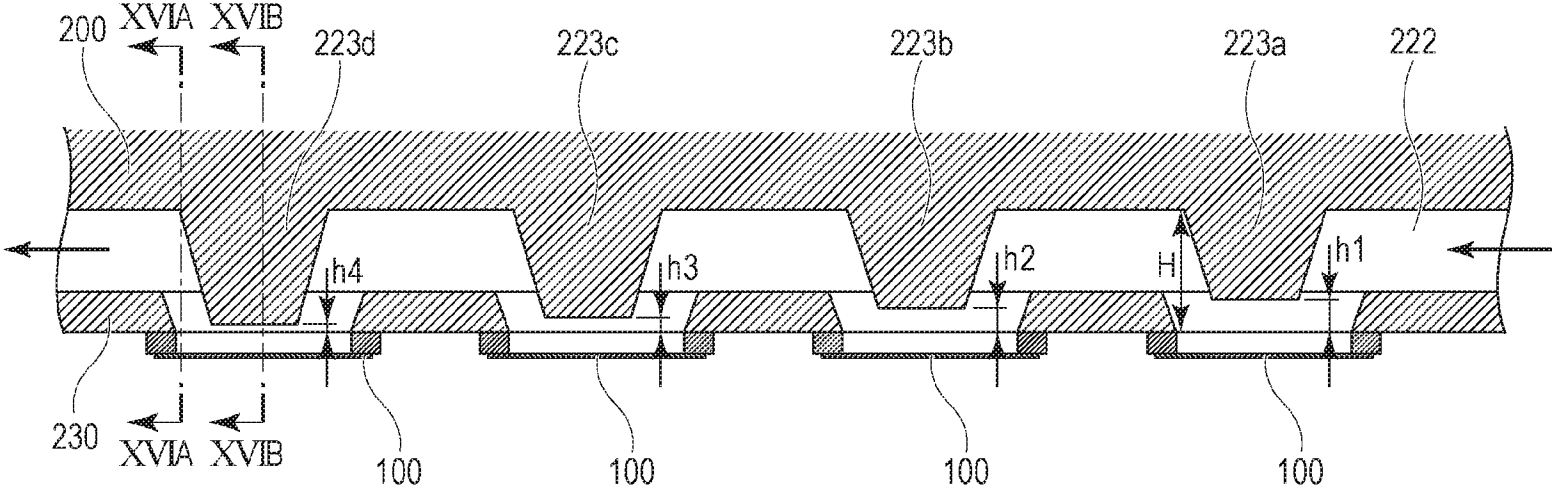
FIG. 15 is a sectional view of a modification of the channel structure in the fourth embodiment.
Figure 16A:
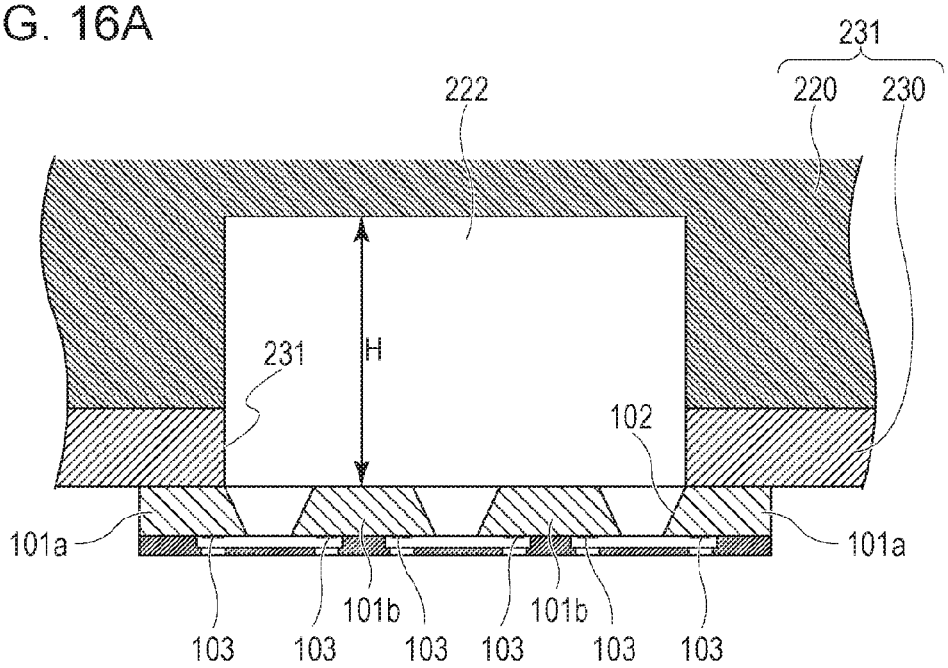
FIG. 16A and FIG. 16B are a sectional view along line XVIA-XVIA and a sectional view along line XVIB-XVIB that are shown in FIG. 15, respectively.
Figure 16B:
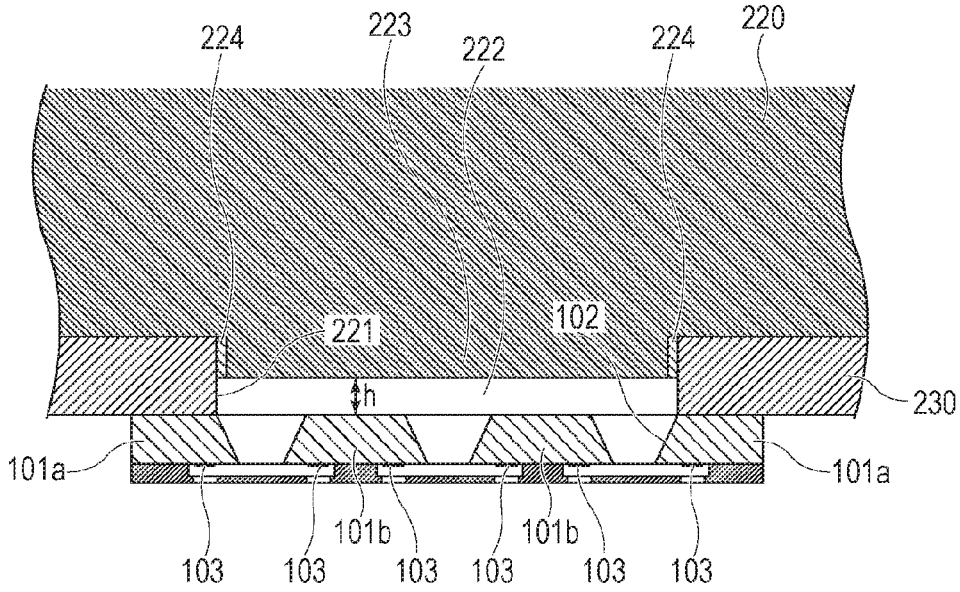

In the fourth embodiment, since no beam is provided within each of the liquid introduction ports 231, as shown in FIG. 15, FIG. 16A, and FIG. 16B, the projections 223 (223*a* to 223*d*) can be formed so as to enter the respective liquid introduction ports 231. It is also effective to seal spaces between the projections 223 and the liquid introduction ports 231 with a sealant 224 to prevent small bubbles from entering the spaces. The distance h between each projection 223 and the outer surface of the support member 230, in other words, the distance h (h1 to h4) between each projection 223 and the back surface (upper surface in the figure) of the corresponding print element substrate 100 can be determined to be a desirable value independently of the thickness of the support portion 210. For example, the distance may be approximately 0.1 to 1 mm.

In the fourth embodiment, since the inner regions 101*b* can be cooled with a high efficiency, the print element substrates can be maintained at a desired temperature, even when the flow rate of the circulating liquid is decreased in accordance with specifications required for the liquid discharging head. Accordingly, the size of a pump installed in the liquid discharge apparatus can be further reduced to downsize the liquid discharge apparatus.

Other Embodiment

In the embodiments, although the liquid discharging head used in the full-line-type liquid discharge printing apparatus has been described by way of example, the present invention can be applied to liquid discharging heads used in other recording-type liquid discharge printing apparatuses. For example, the present invention can be applied to a liquid discharging head used in a serial-type liquid discharge printing apparatus, in which a recording medium is intermittently fed and the liquid discharging head is moved in the direction perpendicular to the direction in which the recording medium is fed for recording.

In the embodiments, the sectional area of the liquid supply channel is increased in accordance with the order in which the recording elements are disposed in the direction in which the liquid flows through the main channel (liquid supply channel) formed in the support member that supports the print element substrates. The sectional area of the liquid supply channel, however, may be determined not in accordance with the order in which the recording elements are disposed but in accordance with positions at which the print element substrates are disposed, or frequency of use thereof, i.e., the amount of liquid discharged per unit time.

The liquid discharging head according to the present invention can reduce the difference in temperature in each print element substrate and the difference in temperature among the print element substrates without increasing the flow rate of the liquid circulating through the liquid discharging head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-060852, filed Mar. 24, 2015, which is hereby incorporated by reference herein in its entirety.

What is claimed is:

1. A liquid discharging head comprising:

first and second print element substrates, each including a discharge-port defining member having a plurality of discharge-ports configured to discharge a liquid, and a plurality of energy-generating elements that generate energy used to discharge the liquid from the discharge-ports; and a support member that supports the first and second print element substrates and includes a shared channel through which the liquid is supplied to the first and second print element substrates, wherein the first print element substrate is disposed on an upstream side of the second print element substrate in a direction in which the liquid flowing through the shared channel is supplied, and wherein a sectional area of the shared channel where the second print element substrate is disposed is smaller than a sectional area of the shared channel where the first print element substrate is disposed.

2. The liquid discharging head according to claim 1, further comprising at a position between the first print element substrate and the second print element substrate on the support member, a third print element substrate that communicates with the shared channel, wherein a sectional area of the shared channel where the third print element substrate is disposed is larger than the sectional area of the shared channel where the second print element substrate is disposed and equal to or smaller than the sectional area of the shared channel where the first print element substrate is disposed.

3. The liquid discharging head according to claim 1, wherein the support member has plural liquid introduction ports through which the liquid is supplied to the print element substrates from the shared channel.

4. The liquid discharging head according to claim 3, wherein projections extending toward the liquid introduction ports are formed on an inner surface of the shared channel.

5. The liquid discharging head according to claim 4, wherein the projection formed at a position corresponding to the second print element substrate is longer than the projection formed at a position corresponding to the first print element substrate.

6. The liquid discharging head according to claim 1, wherein the support member includes a first support member and a second support member that are stacked.

7. The liquid discharging head according to claim 6, wherein the first support member is provided with the shared channel and the second support member is provided with liquid introduction ports.

* * * * *